US010442238B2

(12) United States Patent
Zheng et al.

(10) Patent No.: US 10,442,238 B2
(45) Date of Patent: Oct. 15, 2019

(54) ELECTRIC PENCIL SHARPENER

(71) Applicant: Ningbo Tiantian Stationery Co., Ltd., Ningbo, Zhejiang (CN)

(72) Inventors: Chongting Zheng, Zhejiang (CN); Guangshui Huang, Zhejiang (CN)

(73) Assignee: Ningbo Tiantian Stationery Co., Ltd., Ningbo (CN)

( * ) Notice: Subject to any disclaimer, the term of this patent is extended or adjusted under 35 U.S.C. 154(b) by 208 days.

(21) Appl. No.: 15/668,707

(22) Filed: Aug. 4, 2017

(65) Prior Publication Data

US 2018/0236809 A1 Aug. 23, 2018

(30) Foreign Application Priority Data

Feb. 21, 2017 (CN) ..... 2017 1 0123291
Mar. 20, 2017 (CN) ..... 2017 1 0201261

(51) Int. Cl.
*B43L 23/02* (2006.01)

(52) U.S. Cl.
CPC ..... *B43L 23/02* (2013.01)

(58) Field of Classification Search
CPC ..... B43L 23/00; B43L 23/004; B43L 23/008; B43L 23/02; B43L 23/04; B43L 23/06; B43L 23/08; B43L 23/085
See application file for complete search history.

(56) References Cited

U.S. PATENT DOCUMENTS 7,913,731 B2 * 3/2011 Sued ..... B43L 23/00 144/28.72
8,353,323 B2 * 1/2013 Schumacher ..... B43L 23/00 144/28.1
9,352,608 B2 * 5/2016 Hsu ..... B43L 23/00
10,124,622 B2 * 11/2018 Schumacher ..... B43L 23/02

* cited by examiner

*Primary Examiner* — Matthew Katcoff

(57) ABSTRACT

An electric pencil sharpener includes a housing, the bottom of the housing is provided with a driving device, the upper part of the housing is provided with a fixed sleeve which is provided therein with a hob seat, a cutter holder is provided in the hob seat, a hob cutter is provided in the cutter holder; at least two taper holes with different conical angles are provided around the hob cutter peripherally; the housing is provided thereon with a turn button, the turn button is connected with the cutter holder and is turned to drive the cutter holder to be turned so that any one of the taper holes is aligned with a sleeve-in hole; the driving device drives the hob cutter seat to be turned, the hob seat drives the cutter holder and the hob cutter to be turned, the hob cutter drives the fixed sleeve to be turned.

12 Claims, 15 Drawing Sheets

ELECTRIC PENCIL SHARPENER

CROSS REFERENCE TO RELATED APPLICATIONS

The present application claims the benefit of Chinese Patent Application Nos. 201710201261.3 filed on Mar. 20, 2017 and 201710123291.7 filed on Feb. 21, 2017. All the above are hereby incorporated by reference.

TECHNICAL FIELD OF THE INVENTION

The present invention relates to an electric pencil sharpener.

BACKGROUND

An electric pencil sharpener may automatically cut a conical pencil tip. A pencil is an indispensable drawing tool for arts and crafts workers, during pencil sketch, sculpture and costume design, craftsmen require the conical pencil tip having different conical angles to draw, sketch and embroider. However, the general electric pencil sharpener may only cut out the cone pen tip having one angle, by necessity, the art workers will manually cut and polish by means of a utility knife and abrasive paper to prepare a pencil having the conical pencil tip with different conical angles. A hand-cut pencil needs skilled pencil-cut basic skills, and has low efficiency, long time-consuming, and hard trouble.

SUMMARY

The technical problem to be solved by the present invention is to provide an electric pencil sharpener capable of cutting a pencil tip having a plurality of conical angles.

According to the technical solution of the present invention, there is provided an electric pencil sharpener having the following structure and including a housing, the bottom of the housing is provided with a driving device, the upper part of the housing is provided with a fixed sleeve; the fixed sleeve is provided therein with a hob seat, a cutter holder is provided in the hob seat, a hob cutter is provided in the cutter holder; at least two taper holes with the different conical angles are provided around the hob cutter on the cutter holder peripherally; the housing is provided thereon with a turn button, the turn button is connected with the cutter holder, the turn button is turned to drive the cutter holder to be turned so that any one of the taper holes is aligned with a sleeve-in hole in the fixed sleeve in terms of coaxial lines thereof; the driving device drives the hob seat to be turned, the hob seat drives the cutter holder and the hob cutter to be turned, the hob cutter drives the fixed sleeve to be turned.

With the above structure, the electric pencil sharpener of the present invention has the following advantages as compared with the prior art:

as at least two tamper holes with different conical angles are provided around the hob cutter on the cutter holder of the electric pencil sharpener of the present invention, the turn button is turned to drive the cutter holder to be turned so that any one of the taper holes is aligned with the sleeve-in hole in the fixed sleeve in terms of coaxial lines thereof, therefore, the electric pencil sharpener can cut the pencil tip with a variety of the conical angles, which can meet the needs of art workers.

The turn button is connected with the cutter holder via a manner that a gear provided with an external tooth is meshed with a rack provided with an inner tooth.

The turn button may be connected on the upper end surface of the housing circumferentially and rotatably, the middle of the turn button is provided with a pencil-inserting opening, the pencil-inserting opening is aligned with the sleeve-in hole in terms of coaxial lines thereof.

The lower surface of the turn button is provided with a hollow convex neck, a through hole of the convex neck is coaxial with the pencil-inserting opening; the outer surface of the convex neck is provided with a button gear with an external tooth, the lower end of the convex neck passes through the sleeve-in hole of the fixed sleeve, and a seat-in hole of the hob seat is positioned above the cutter holder; the upper surface of the cutter holder is provided with a frame arc tooth with the inner tooth, the button gear is meshed with the frame arc tooth.

The hob seat includes a top plate, a bottom plate and a connected plate; the connected plate is connected between the top plate and the bottom plate; the cutter holder may be turned circumferentially and movable up and down by a spring and an external force to be mounted in a space formed by the top plate, the bottom plate and the connected plate, the button gear is disengaged from the frame arc tooth when the cutter holder is moved downwardly to a set position; the seat-in hole is provided on the top plate; the tapper hole is positioned at the lower side of the seat-in hole, the taper hole may be aligned with the seat-in hole in terms of coaxial lines thereof.

The inner surface of the connected plate is provided thereon with an arc limited groove, the outer surface of the cutter holder, being opposite to the arc limited groove, is provided with a convex; the convex is received in the arc limited groove.

The inner surface of the connected plate is provided thereon with an arc groove of which two ends are opened; the lower surface of the arc groove is provided with a blocking groove of which the number corresponds to the number of the taper holes, the distance between the center-lines of the two adjacent blocking grooves is equal to the distance between the axes of two adjacent corresponding taper holes; the outer surface of the cutter holder, being opposite to the arc limited groove, is provided with a blocking block; after an axial hole is aligned with the through hole of the convex neck and the cutter holder is pressed down, the blocking block is caught in the corresponding blocking groove.

The axial holes on the cutter holder are equally spaced, i.e. the distances between the axes of two adjacent taper holes are all equal.

The lower end surface of the cutter holder is provided with a contact rod, the contact rod passes through the bottom plate of the hob seat and is exposed outside the hob seat; the bottom of the housing is provided with a switch for starting the driving device; the lower end of the contact rod is provided with a contact head which is positioned above the switch; a spring is provided between the contact head and the switch; the contact head presses down the switch to drive the driving device to be operated when the contact head moves downwardly to a set position.

The hob cutter includes a cylindrical cutter body and a cutter gear, the cutter gear is fixedly connected on the upper end of the cutter body; the hob cutter may be hinged in the cutter holder circumferentially and rotatably, and the outer side of the cutter gear is exposed outside the hob seat; an inner gear is provided at a position on the inner wall of the fixed sleeve, which corresponds to the cutter gear the cutter gear may be meshed with the inner gear.

The cylindrical surface of the cutter body is provided thereon with a plurality of milling cutters which are provided with a helical edge, the outer surface of each the helical edge is provided with a plurality of chip breaker grooves of which the upper and the lower sides are opened. With this structure, the uniformity and continuity of chips in a chip-discharge groove are broken by squeezing a node, therefore, the chips in the chip-discharge groove are automatically broken and discharged from the chip-discharge groove, so that a planetary type pencil sharpener eliminates the blocking phenomenon of the chips, realizing automatic chip breakage and discharge and automatically emptying the chip-discharge groove, milling efficiency is constant and manual chip removal is not needed, thus providing convenience for the user.

Figure 1:
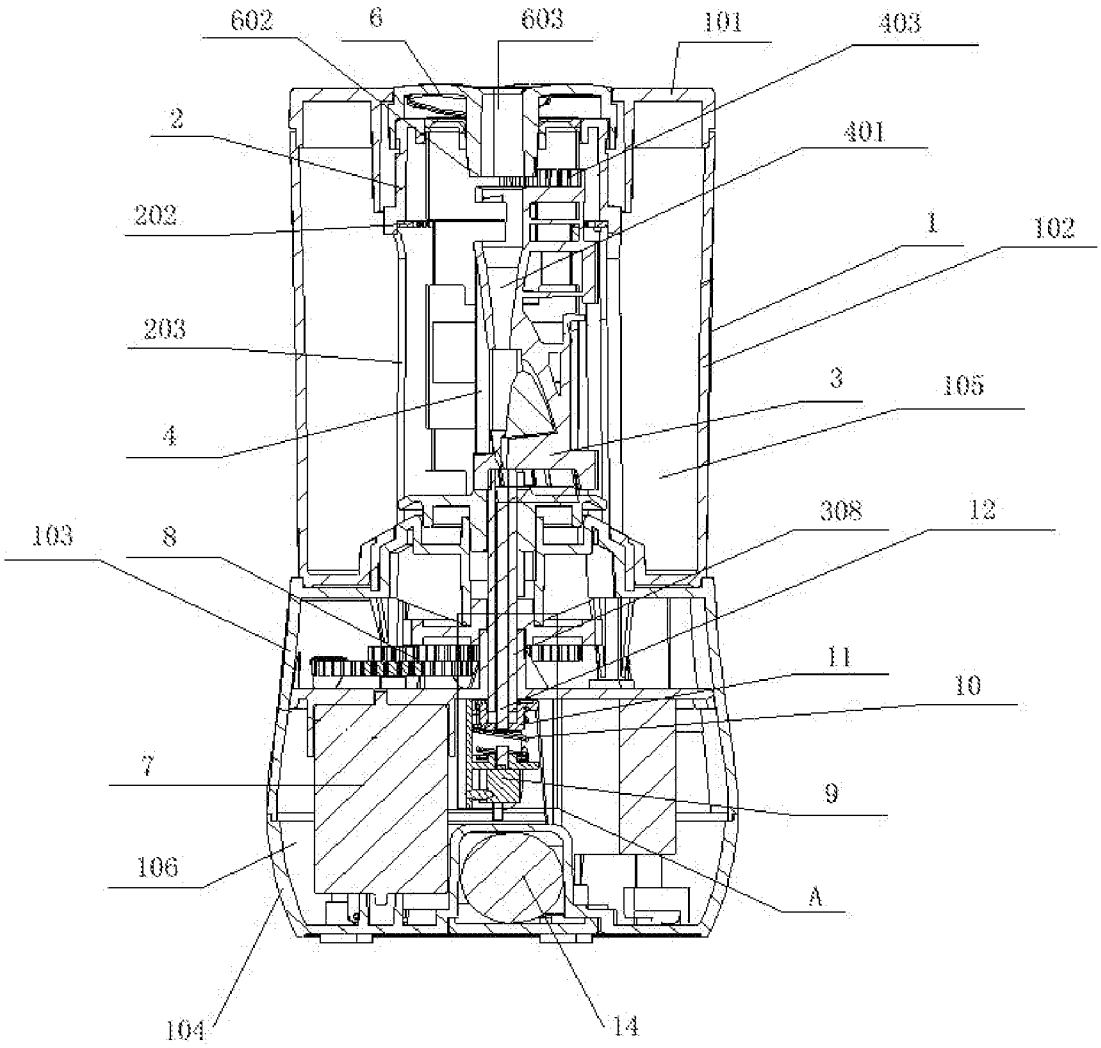
FIG. 1 is a cross-sectional structural diagram of an electric pencil sharpener according to the present invention, in which a taper hole A is aligned with a pencil-inserting opening.
Figure 2:
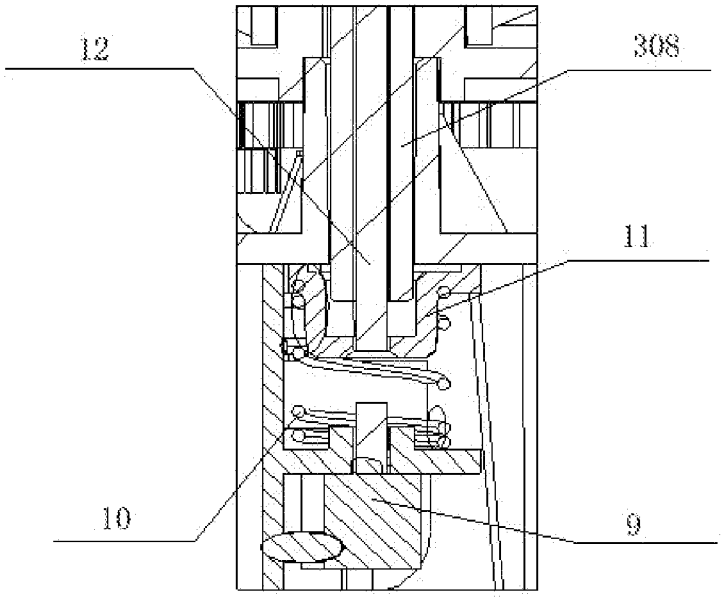
FIG. 2 is an enlarged diagram of a part A in FIG. 1.
Figure 3:
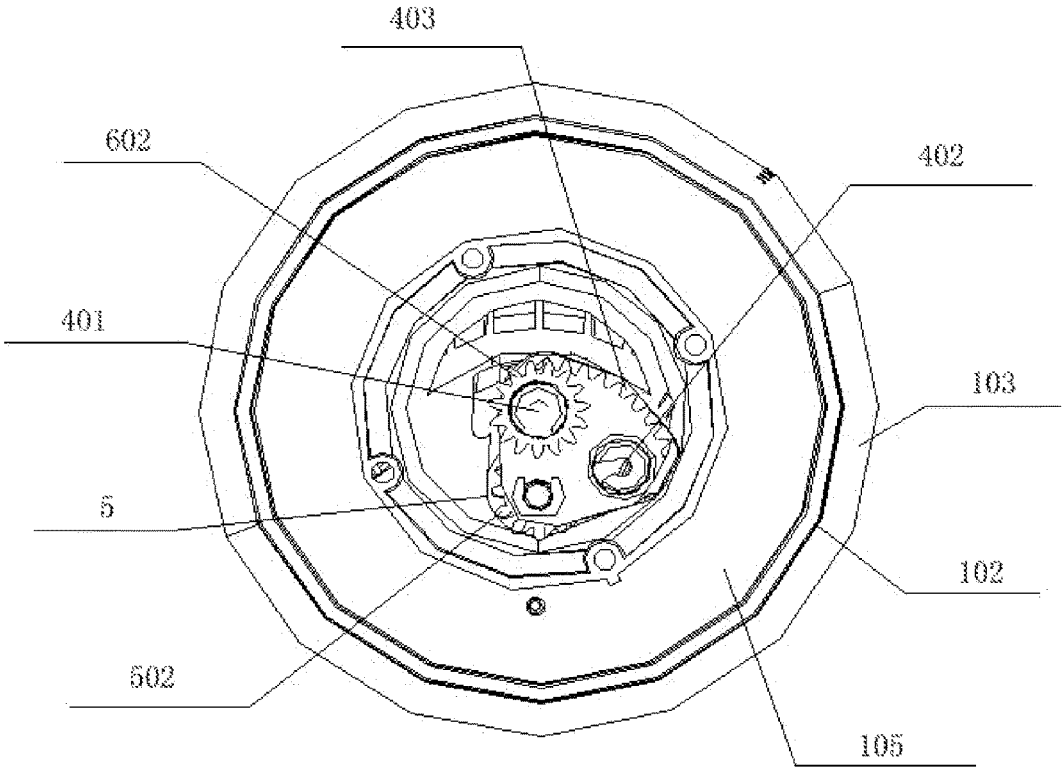
FIG. 3 is a top cross-sectional diagram of FIG. 1.

In the drawings: 1, housing, 101, top cover, 102, upper housing, 103, middle housing, 104, lower housing, 105, chip bin, 106, electromechanical bin, 2, fixed sleeve, 201, sleeve-in hole, 202, inner gear, 203, chip-discharge opening, 3, hob seat, 301, seat-in hole, 302, top plate, 303, bottom plate, 304, connected plate, 305, arc limited groove, 306, arc groove, 307, blocking groove, 308, spline shaft, 309, shaft blind hole, 4, cutter holder, 401, taper hole A, 402, taper hole B, 403, frame arc tooth, 404, convex, 405, blocking block, 5, hob cutter, 501, cutter body, 502, cutter gear, 503, milling cutter, 504, chip breaker groove, 6, turn button, 601, convex neck, 602, button gear, 7, motor, 8, speed reducer, 801, spline hole, 9, switch, 10, spring, 11, contact head, 12, contact rod, 13, charging port, 14, rechargeable battery.

DETAILED DESCRIPTION

Hereinafter, the technical solution of the present invention will be described in further details with reference to the embodiments of the present invention and the combination of the accompanying drawings, but the present invention is not limited to these embodiments.

As shown in FIGS. 1-5, an electric pencil sharpener according to the present invention includes a housing 1, the bottom of the housing 1 is provided with a driving device, the upper part of the housing 1 is provided with a fixed sleeve; the side wall of the fixed sleeve 2 is provided thereon with a chip-discharge opening 203. the fixed sleeve 2 is provided therein with a hob seat 3, a cutter holder 3 is provided in the hob seat 4, a hob cutter 5 is provided in the cutter holder 4; at least two taper holes with different conical angles are provided around the hob cutter 5 on the cutter holder peripherally; the housing 1 is provided thereon with a turn button 6, the turn button 6 is connected with the cutter holder 4, the turn button 6 is turned to drive the cutter holder 4 to be turned so that any one of the taper holes is aligned with a sleeve-in hole 201 in the fixed sleeve 2 in terms of coaxial lines thereof; the driving device drives the hob seat 3 to be turned, the hob seat 3 drives the cutter holder 4 and the hob cutter 5 to be turned, the hob cutter 5 drives the fixed sleeve 2 to be turned.

The middle of the upper end of the fixed sleeve 2 is provided with the sleeve-in hole 201, the middle of the upper end of the hob seat 3 is provided with a seat-in hole 301, the end of a pencil may pass through the sleeve-in hole 201, the seat-in hole 301 and is inserted into the taper hole when the sleeve-in hole 201, the seat-in hole 301 and the taper hole are aligned with each other in terms of coaxial lines thereof. By means of the turn button 6, it is possible to adjust different taper holes to be aligned with the sleeve-in hole 201 and the seat-in hole 301 in terms of coaxial lines thereof, as two taper holes with different conical angles are provided, at least two pencil tips with different taper holes may be cut.

As shown in FIGS. 6-11, the turn button 6 is connected with the cutter holder 4 via a manner that a gear provided with an external tooth is meshed with a rack provided with an inner tooth. Specifically, the turn button may be connected on the upper end surface of the housing 1 circumferentially and rotatably, the middle of the turn button 6 is provided with a pencil-inserting opening, the pencil-inserting opening 603 is aligned with the sleeve-in hole in terms of coaxial lines thereof.

The lower surface of the turn button 6 is provided with a hollow convex neck 601, a through hole of the convex neck 601 is coaxial with the pencil-inserting opening 603; the outer surface of the convex neck 601 is provided with a button gear 602 with an external tooth, the lower end of the convex neck 601 passes through the sleeve-in hole 201 of the fixed sleeve 2, and the seat-in hole 301 of the hob seat 3 is positioned above the cutter holder 4; the upper surface of the cutter holder 4 is provided with a frame arc tooth with the inner tooth 403, the button gear 602 is meshed with the frame arc tooth 403.

The hob seat 3 includes a top plate 302, a bottom plate 303 and a connected plate 304; the connected plate 304 is connected between the top plate 302 and the bottom plate 303, that is to say, the connected plate 304 is connected between the edges of the top plate 302 and the bottom plate 303; the cutter holder 4 may be turned circumferentially and movable up and down by a spring and an external force to be mounted in a space formed by the top plate 302, the bottom plate 303 and the connected plate 304, the button gear 602 is disengaged from the frame arc tooth 403 when the cutter holder 4 is moved downwardly to a set position; the seat-in hole 301 is provided on the top plate 302; the tapper hole is positioned at the lower side of the seat-in hole 301, the turn button 6 is turned to drive the cutter holder 4 to be turned so that the taper hole is aligned with the seat-in hole 301 in terms of coaxial lines thereof.

Figure 12:
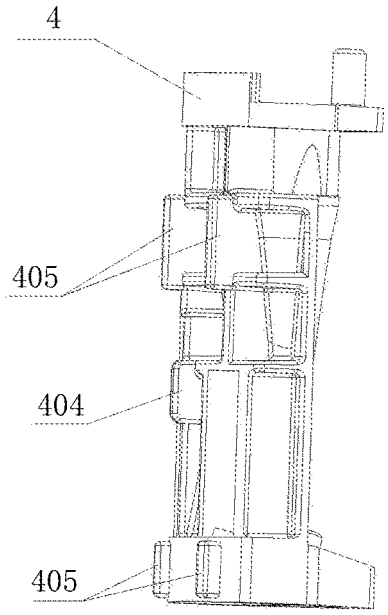
FIG. 12 is a structural diagram of a cutting holder of an electric pencil sharpener according to the present invention.
Figure 13:
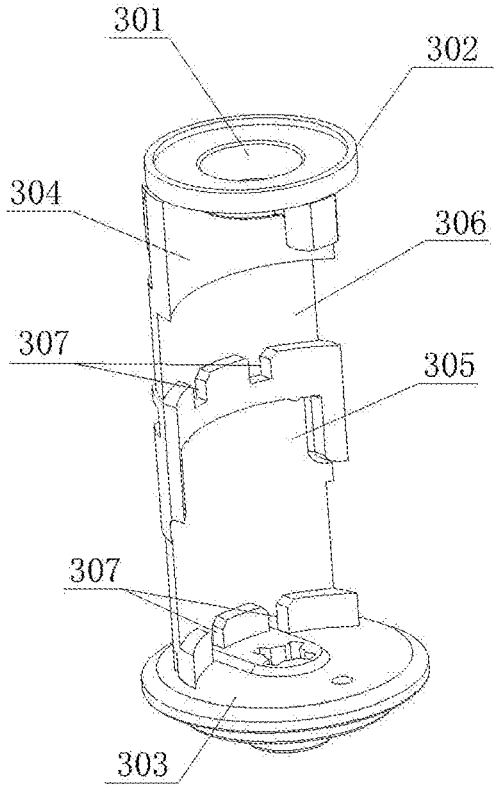
FIG. 13 is a structural diagram of a hob seat of an electric pencil sharpener according to the present invention.

As shown in FIGS. 12-13, the inner surface of the connected plate 304 is provided thereon with an arc limited groove 305, the outer surface of the cutter holder 4, being opposite to the arc limited groove 305, is provided with a convex 404; the convex 404 is received in the arc limited groove 305, is limited and moved in the arc limited groove 305 and may be moved along the length and height directions of the arc limited groove 305. the lower side of the arc limited groove 305 is provided with an opening, the convex 404 is not limited by a lower edge of the arc limited groove, thus, during the downward movement of the tool holder 4, the convex 404 is not affected by the edge of the arc limited groove 305, making the structure of the hob seat 3 simpler.

The inner surface of the connected plate 304 is provided thereon with the arc limited groove 306 of which two ends are opened; the lower surface of the arc groove 306 is provided with a blocking groove 307 of which the number corresponds to the number of the taper holes, the distance between the centerlines of the two adjacent blocking groove 307 is equal to the distance between the axes of two adjacent corresponding taper holes; the outer surface of the cutter holder, being opposite to the arc limited groove, is provided with a blocking block; after a taper hole is aligned with the through hole of the convex neck 601 in terms of coaxial lines thereof and the cutter holder is pressed down, the blocking block 405 is caught in the corresponding blocking groove. In order to make the structure more stable, a plurality of sets of the arc grooves 306 and the blocking blocks 405 may be provided. The axial holes on the cutter holder 4 are equally spaced, i.e. the distances between the axes of two adjacent taper holes are all equal.

The lower end surface of the cutter holder 4 is provided with a contact rod 12, the contact rod 12 passes through the bottom plate of the hob seat 3 and is exposed outside the hob seat 3; the bottom of the housing 1 is provided with a switch 9 for starting the driving device; the lower end of the contact rod 12 is provided with a contact head which is positioned above the switch 9; a spring 10 is provided between the contact head 11 and the switch 9; the contact head 11 presses down the switch 9 to drive the driving device to be operated when the contact head 11 moves downwardly to a set position.

In this embodiment, the cutter holder 4 is provided thereon with two taper holes, which are a taper hole A 401 and a taper hole B 402, respectively, the conical angles of the taper hole A 401 and the taper hole B 402 are different, the taper hole A 401 is a cutting hole of a small taper conical pencil tip, the taper hole B 402 is a cutting hole of a big taper conical pencil tip, that is to say, a pencil core of the pencil tip, being cut by the taper hole A 401, is longer, while a pencil core of the pencil tip, being cut by the taper hole B 402, is shorter. two blocking grooves are also provided while two blocking blocks are also provided, the distance between two blocking grooves and two adjacent side edges is smaller than that between the centerlines of the two blocking grooves 3074, with this structure, when the taper hole is switched, one of the blocking block 405 is not biased against the lower surface of the arc groove 306 of the blocking groove 307, so that the cutter holder 4 may not be moved downwardly. The arc groove 306 and the blocking block 405 are provided in two groups.

Figure 14:
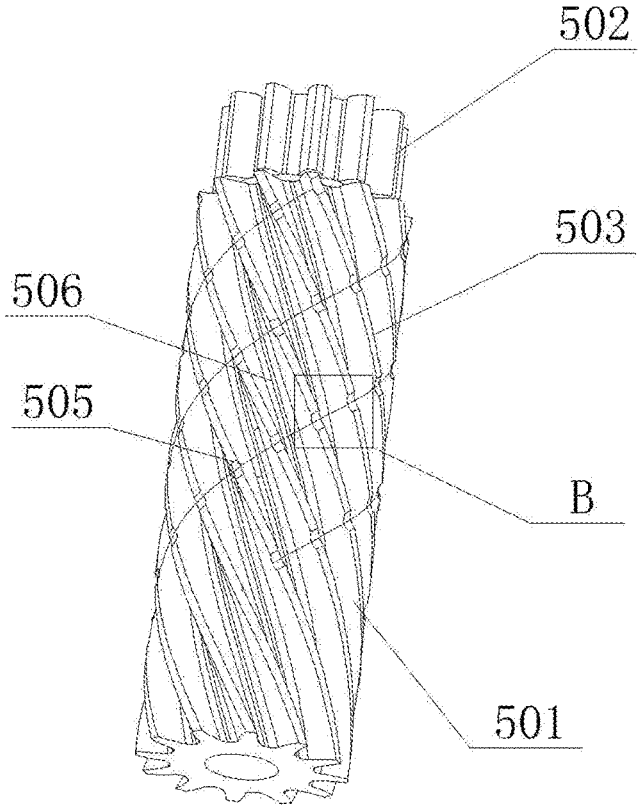
FIG. 14 is a perspective structural diagram of a hob of an electric pencil sharpener according to the present invention.
Figure 15:
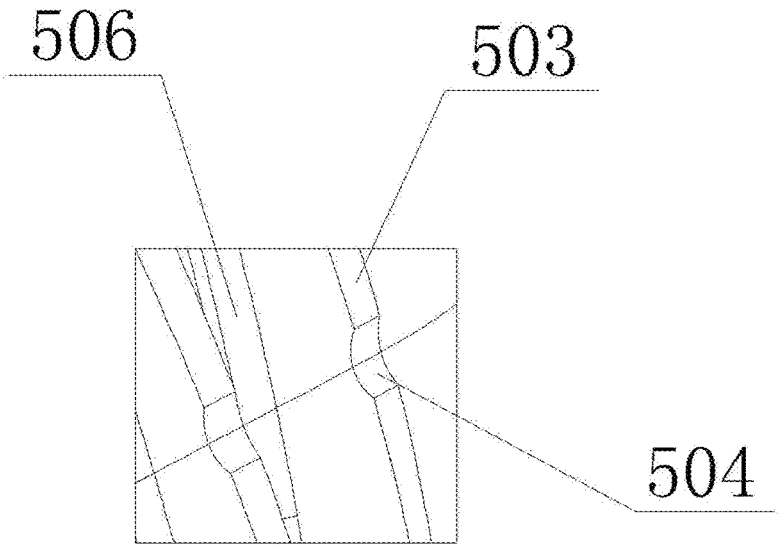
FIG. 15 is an enlarged diagram of a part B in FIG. 14.

As shown in FIGS. 14-15, the hob cutter 5 includes a cylindrical cutter body 501 and a cutter gear 502, the cutter gear 502 is fixedly connected on the upper end of the cutter body 501; the hob cutter may be hinged in the cutter holder 4 circumferentially and rotatably, and the outer side of the cutter gear 502 is exposed outside the hob seat 3; an inner gear 202 is provided at a position on the inner wall of the fixed sleeve 2, which corresponds to the cutter gear 502, the cutter gear 502 may be meshed with the inner gear 202.

The cylindrical surface of the cutter body 501 is provided thereon with a plurality of milling cutters 503 which are provided with a helical edge, the outer surface of each the helical edge is provided with a plurality of chip breaker grooves 504 of which the upper and the lower sides are opened. Connected lines of the two adjacent chip breaker grooves 504 of the adjacent double-head milling cutter 503 are spliced to be capable of forming helical lines, the helical line is an imaginary line. The spiral direction of the helical line is opposite to the helical direction of the helical edge, that is to say, the spiral edge is left-forward rotation while the helical line is right-forward rotation; that is to say, the spiral edge is right-forward rotation while the helical line is left-forward rotation. The cross-sectional shape of the chip breaker groove 504 is circular, rectangular or triangular.

Figure 4:
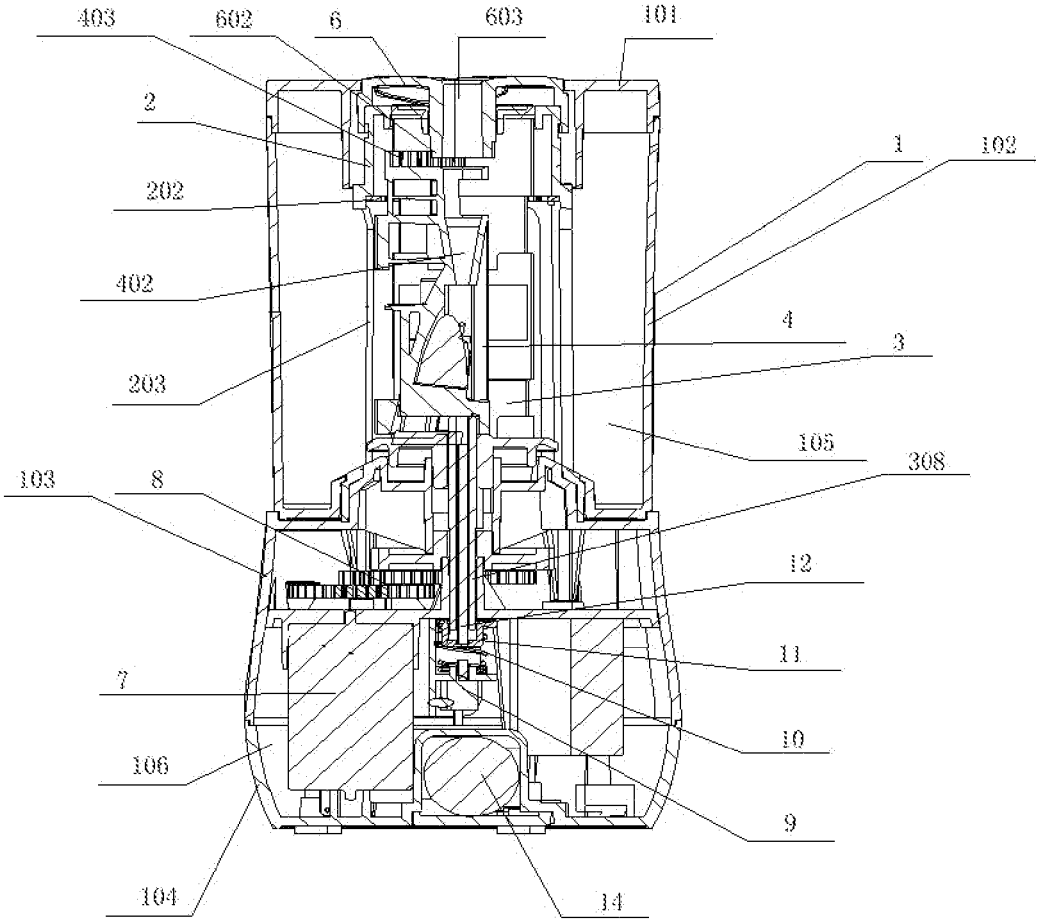
FIG. 4 is a cross-sectional structural diagram of an electric pencil sharpener according to the present invention, in which a taper hole B is aligned with a pencil-inserting opening.
Figure 5:
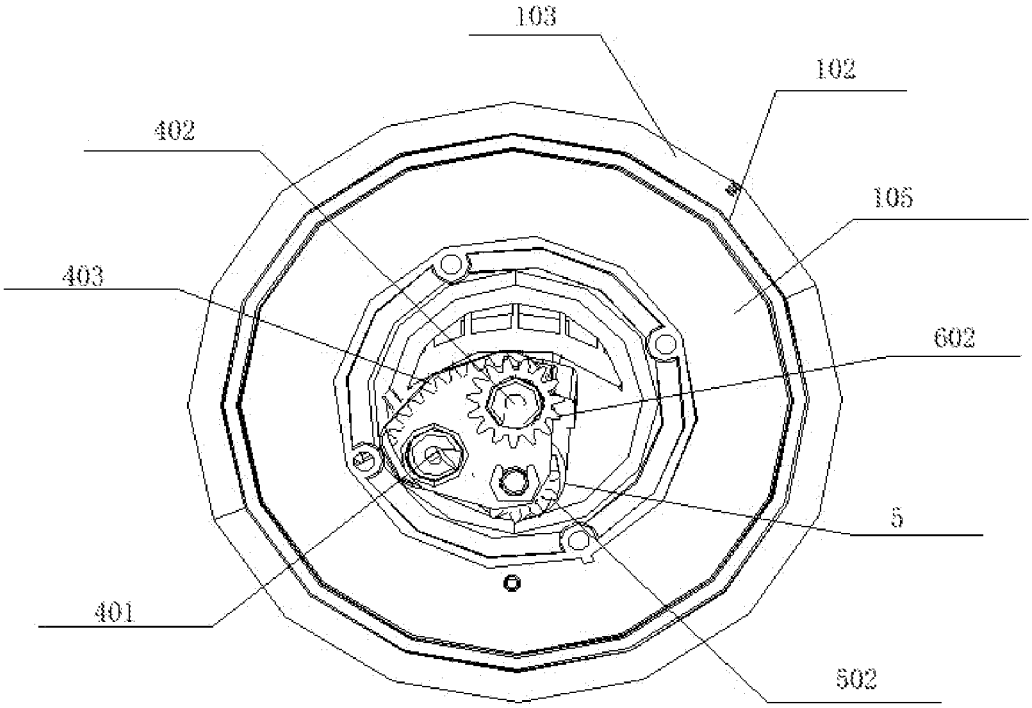
FIG. 5 is a top cross-sectional diagram of FIG. 4.
Figure 6:
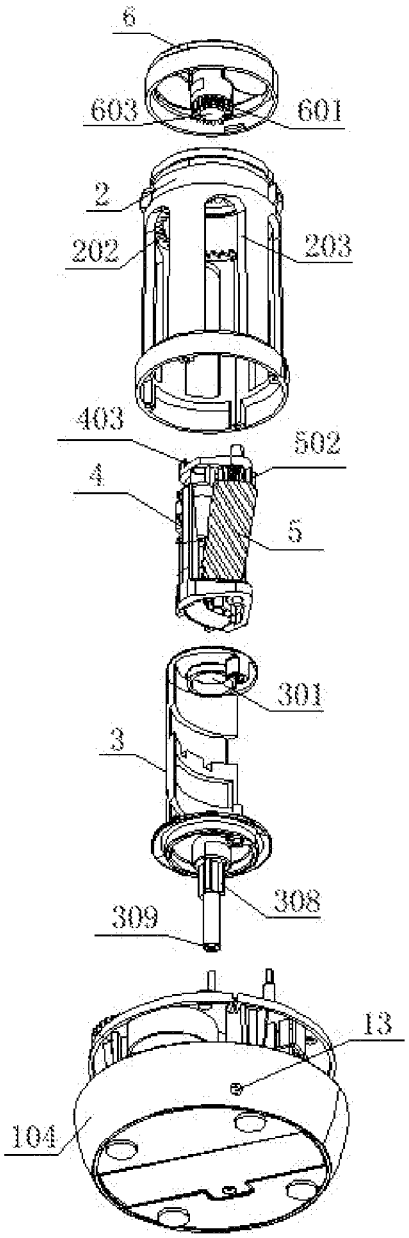
FIG. 6 is an upward axonometric decomposition diagram of an electric pencil sharpener according to the present invention, in which a top cover, an upper housing and a middle housing are omitted.
Figure 7:
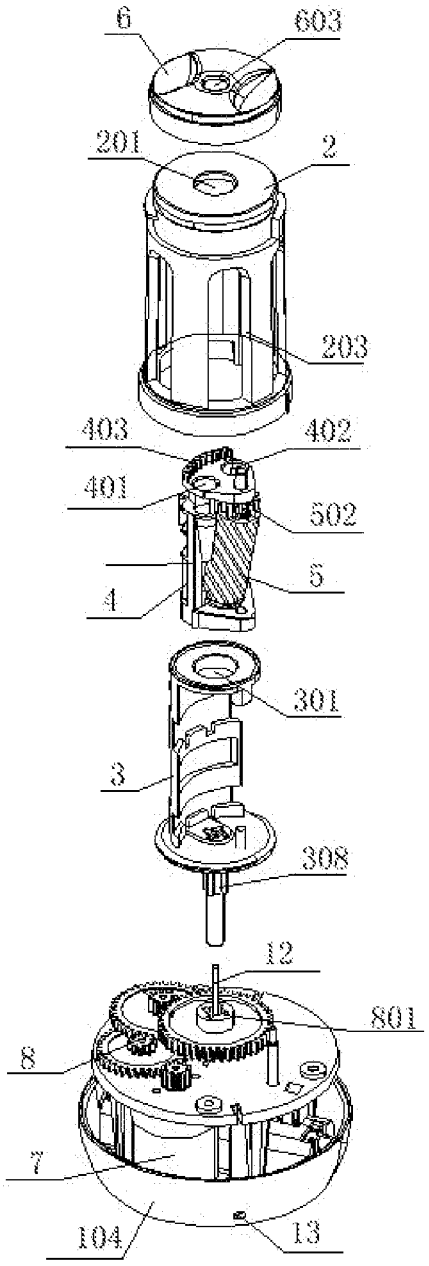
FIG. 7 is a top axonometric decomposition diagram of an electric pencil sharpener according to the present invention, in which a top cover, an upper housing and a middle housing are omitted.
Figure 8:
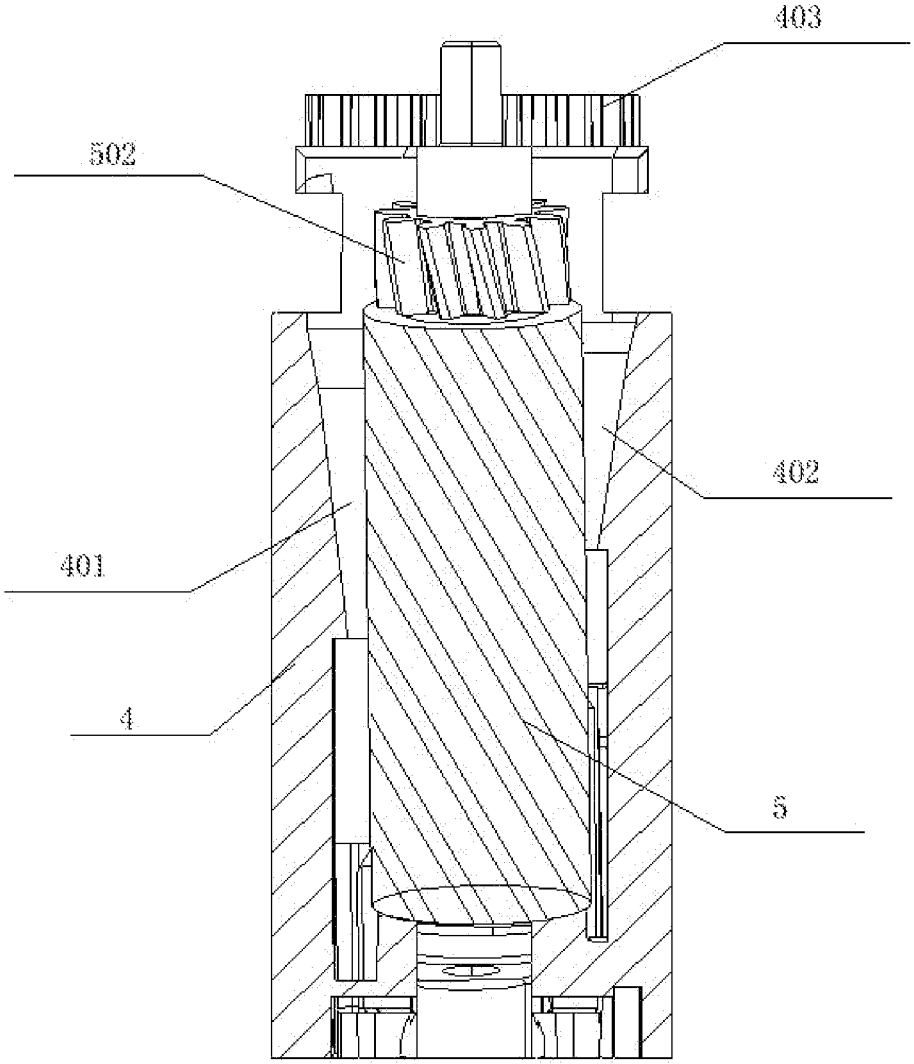
FIG. 8 is a cross-sectional structural diagram of a double-taper-hole hob cutter according to the present invention.
Figure 9:
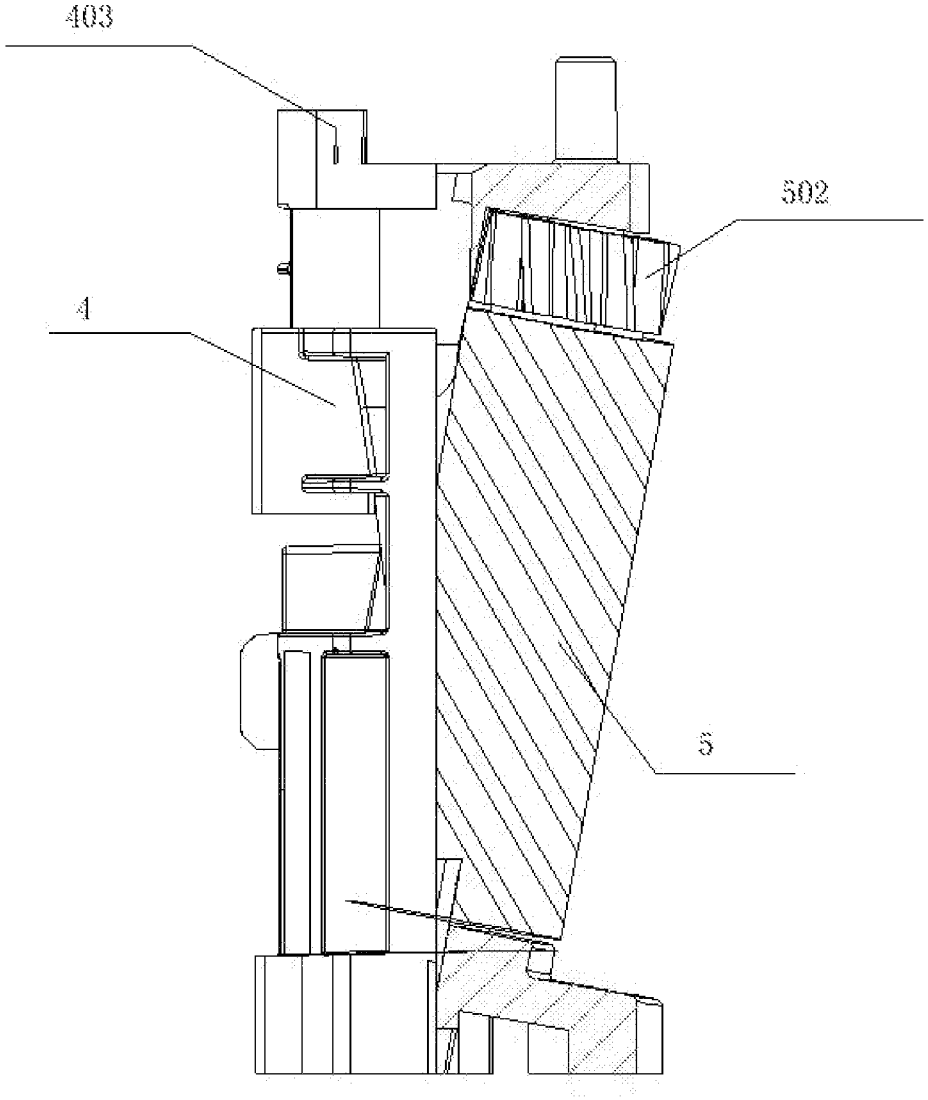
FIG. 9 is a side cross-sectional diagram of FIG. 8.
Figure 10:
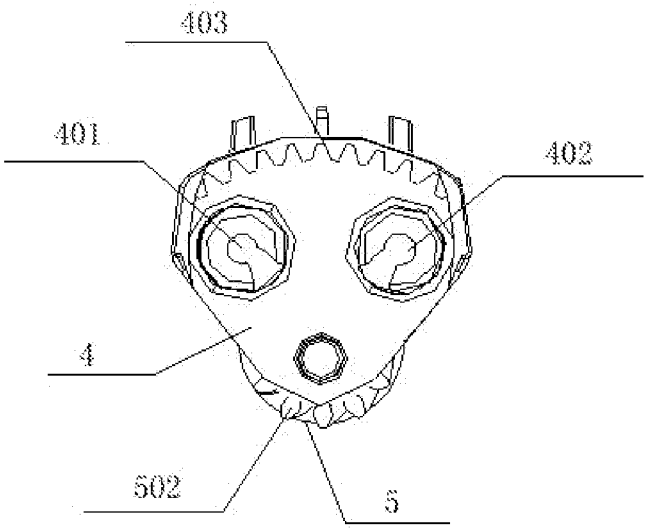
FIG. 10 is a top cross-sectional diagram of FIG. 8.
Figure 11:
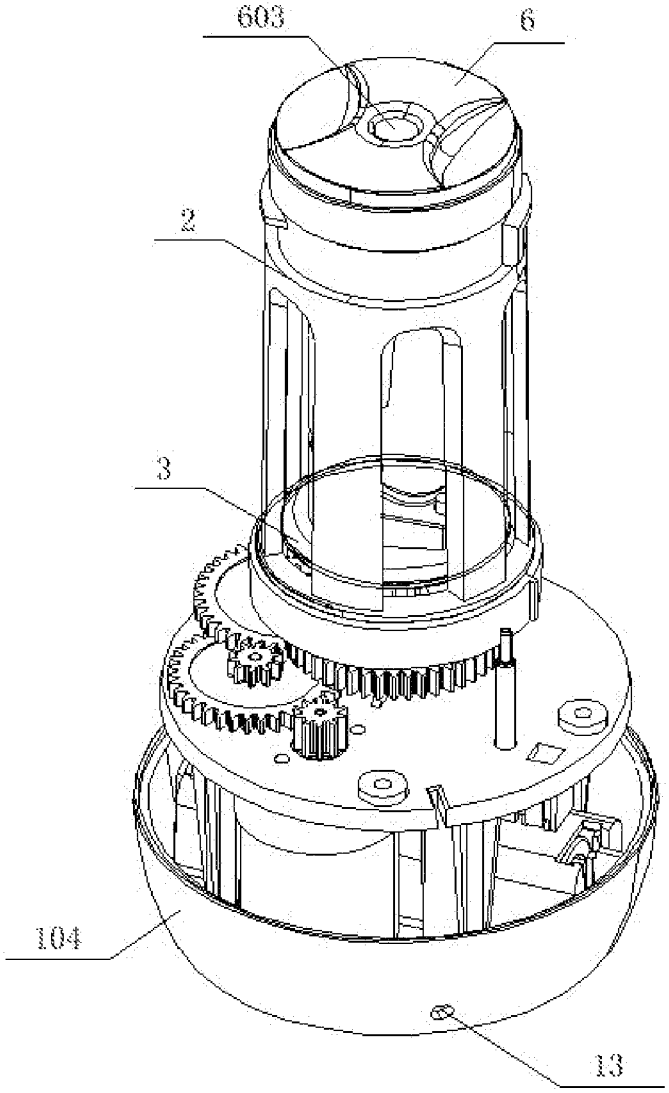
FIG. 11 is an axonometric decomposition diagram of an electric pencil sharpener according to the present invention, in which a top cover, an upper housing and a middle housing are omitted.

As shown in FIGS. 1, 4 and 11, the housing 1 consists of a top cover 101, an upper housing 102, a middle housing 103, and a lower housing 104, wherein the top cover 101 is a plastic member of which the upper part has a top, of which the lower part is open and which has a thin-wall cylindrical cover shape. The center of the upper part of the top cover 101 is provided with a circular through hole called as a cover-in hole, which corresponds to, is slid and is matched with the turn button 6. The upper housing 102 is a plastic member of which the upper part is open, of which the lower surface has a bottom and which has a thin-wall cylindrical barrel shape, the center of the lower surface of the upper housing is provided with a middle hole of the upper housing. The middle housing 103 is a plastic member of which the upper part has a top, of which the lower part is open and which has a thin-wall circular platform cover shape, the upper surface of the middle housing 103 is provided with a middle hole of the middle housing. The lower housing 104 is a plastic member of which the upper part is open, of which the lower surface has a bottom and which has a thin-wall circular platform barrel shape. from up to down, the top cover 101, the upper housing 102, the middle housing 103, and the lower housing 104 are connected in sequence, wherein a cavity enclosed by the top cover 101 and the upper housing 102 is a chip bin 105, a cavity enclosed by the middle housing 103 and the lower housing 104 is an electromechanical bin 106.

The driving device includes an electromechanical group consisting of a motor 7, a speed reducer 8, a switch 9, a spring 10, a contact head 11, a contact rod 12, a charging port 13 and a rechargeable battery 14. The electromechanical group is provided in the electromechanical bin 106, the fixing sleeve 2, the hob seat 3, the cutter holder 4 and the hob cutter 5 are provided in the chip bin 105. The turn button 6 is provided at the cover-in hole of the top cover 101. The upper surface of the turn button 6 is flushed with the upper surface of the top cover 101. The fixed sleeve 2 is fixed above the electromechanical group via the upper housing 102 and the middle housing 103. A spline shaft 308 is provided at the middle of the lower surface of the bottom plate 303 of the hob seat 3, The spline shaft 308 passes through the middle hole of the upper housing, and the middle hole of the middle housing and is slidably bonded and connected to the spline hole 801 of an output wheel of the speed reducer 8 of the electromechanical group. The middle of the spline shaft is provided with a shaft through hole, the shaft through hole passes through the bottom plate of the hob seat. The upper end of the contact rod passes through the shaft through hole and is against the lower end surface of the cutter holder, the lower end of the contact rod is in contact with and connected to the upper surface of the contact head. The switch 9 is positioned under the contact head 11, and a spring 10 is provided between the switch 9 and the contact head 11.

Figure 16:
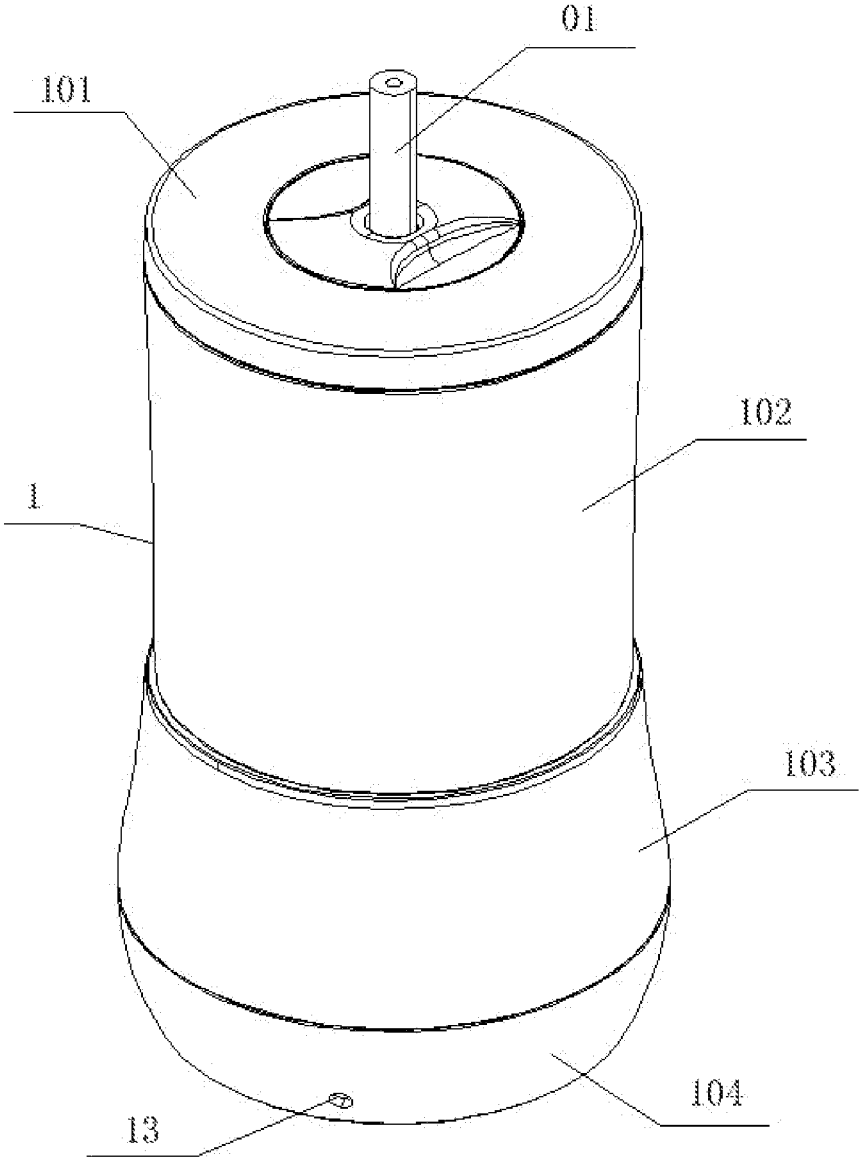
FIG. 16 is an axonometric diagram of an exterior structure of an electric pencil sharpener according to the present invention.
Figure 17:
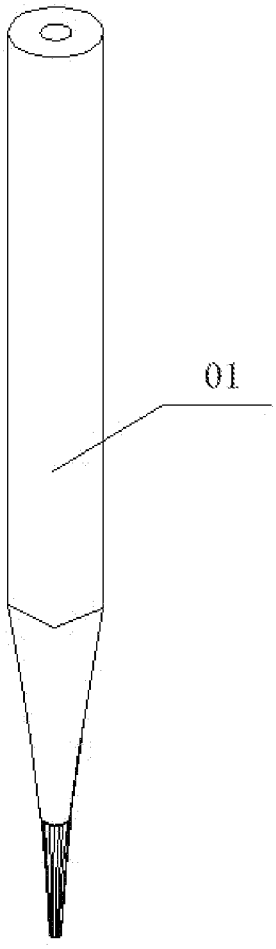
FIG. 17 is a diagram of a pencil 01 cut with a taper hole A.
Figure 18:
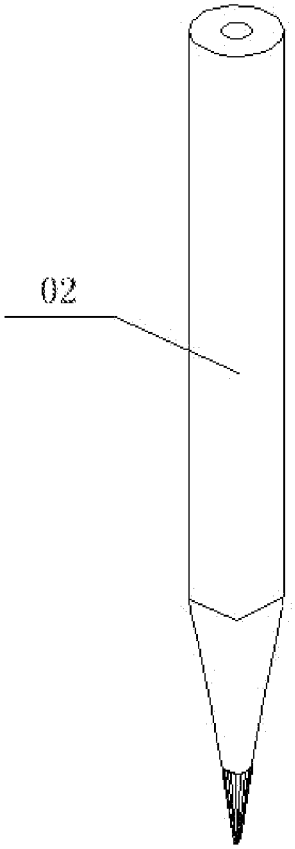
FIG. 18 is a diagram of a pencil 02 cut with a taper hole B.

As shown in FIGS. 16 to 18, the working principle and the advantageous effects of the electric pencil sharpener according to the present invention are as follows:

when a pencil with a longer pencil core is needed to cut, the turn button 6 is turned, the taper hole A 401 is aligned with the pencil-inserting hole 603 in terms of coaxial lines thereof by the action of the turn gear 602 and the frame arc tooth 403, the pencil tip is inserted into the pencil-inserting opening 603 and the taper hole A 401, then the pencil is grasped and pressed down, the blocking block 405 of the cutter holder 4 is blocked into the blocking groove 307, the frame arc tooth 403 is disengaged with the button gear 602; at the same time, the contact rod 12 and the contact head 11 move downwardly against the support of the spring 10, when the lower end of the contact head 11 touches the switch 9, the switch 9 is opened and the motor 7 starts, the motor 7, via the speed reducer 8, an output shaft and the spline hole 801, drives the hob seat 3 and drives the cutter holder 4 and the hob 5 to center on the pencil and be carried out with orbital revolution in the taper hole A 401, at the same time, under the action of the inner gear 202 and the cutter gear 502, the hob 5 rotates along the rotation axis of the pencil 4 while carrying out orbital revolution around the pencil with the pen holder 4, the hob 5 in rotation mills the pencil tip into molding and becomes the shape of the taper hole A 401, that is to say, a taper pencil tip with a small conical angle is obtained.

When the pencil with a shorter pencil core is needed to cut, the turn button 6 is rotated so that the taper hole B 402 is aligned with the pencil-inserting opening 603 in terms of the coaxial lines thereof, the pencil is inserted into the pencil-inserting opening 603 downwardly and applies a force down, similarly, the hob 5 in rotation mills the pencil tip into molding and becomes the shape of the taper hole B 402, that is to say, a taper pencil tip with a big conical angle is obtained.

After being cut, the pencil is pulled out upwardly, under the action of the spring 10, the contact rod 12, the contact rod 11 and the cutter holder 4 are reset upward, the switch 9 is closed, the motor 7 stops, the button gear 602 is reset and meshed with the frame arc tooth 403 again. The chips resulted from the hob 5 milling the pencil are thrown into the chip bin via the chip-discharge opening, after the pencil is cut, the top cover is opened and then the chips may be removed.

The device, via providing the cutter holder and the hob seat as well as a mechanism matched with the cutter and the hob seat, realizes the function that the pencil tip with a big conical angle and a small conical angle may be selected and milled, thus meeting the needs of art workers.

What is claimed is:

1. An electric pencil sharpener, comprising a housing, wherein the bottom of the housing is provided with a driving device, the upper part of the housing is provided with a fixed sleeve; a hob seat is provided in the fixed sleeve, a cutter holder is provided in the hob seat, a hob cutter is provided in the cutter holder; at least two taper holes with different conical angles are provided around the hob cutter on the cutter holder peripherally; the housing is provided thereon with a turn button, the turn button is connected with the cutter holder, the turn button is turnable to drive the cutter holder to be turned so that any one of the taper holes is coaxially aligned with a sleeve-in hole in the fixed sleeve; turning of the hob seat is driven by the driving device, the turning of the hob seat causing turning of the cutter holder and a hob cutter, and the turning of the hob cutter causing turning of the fixed sleeve.

2. The electric pencil sharpener according to claim 1, wherein the turn button is connected with the cutter holder by one of the turn button and the cutter holder having a gear provided with an external tooth and the other having a rack provided with an inner tooth.

3. The electric pencil sharpener according to claim 2, wherein the turn button is connected with an upper end surface of the housing circumferentially and rotatably, the middle of the turn button is provided with a pencil-inserting opening, the pencil-inserting opening is coaxially aligned with the sleeve hole.

4. The electric pencil sharpener according to claim 3, wherein the lower surface of the turn button is provided with a hollow convex neck, a through hole of the convex neck is coaxial with the pencil-inserting opening; the outer surface of the convex neck is provided with a button gear with an external tooth, the lower end of the convex neck passes through the sleeve-in hole of the fixed sleeve, and a seat-in hole of the hob seat is positioned above the cutter holder; the upper surface of the cutter holder is provided with a frame arc tooth with an inner tooth, the button gear is meshed with the frame arc tooth.

5. The electric pencil sharpener according to claim 4, wherein the hob seat comprises a top plate, a bottom plate and a connected plate; the connected plate is connected between the top plate and the bottom plate; the cutter holder is turnable circumferentially and movable up and down in a space formed by the top plate, the bottom plate and the connected plate, the button gear is disengaged from the frame arc tooth when the cutter holder is moved downwardly to a set position; the seat-in hole is provided on the top plate; the taper holes are positioned on the underside of the seat-in hole and are capable of being coaxially aligned with the seat-in hole.

6. The electric pencil sharpener according to claim 5, wherein a limiting groove is provided on the inner surface of the connected plate, the outer surface of the cutter holder, being opposite to the limiting groove, is provided with a convex portion; the convex portion is received in the limiting groove.

7. The electric pencil sharpener according to claim 5, wherein a groove having an arc shape is provided on the inner surface of the connected plate, two ends of the groove are open; the lower surface of the groove is provided with blocking grooves of which the number corresponds to the number of the taper holes, the distance between the centerlines of the two adjacent blocking grooves is equal to the distance between the axes of two adjacent corresponding taper holes; the outer surface of the cutter holder, being opposite to the groove, is provided with a blocking block; after an axle hole is coaxially aligned with the through hole of the convex neck and the cutter holder is pressed down, the blocking blocks are caught in the corresponding blocking grooves.

8. The electric pencil sharpener according to claim 5, wherein the axle holes on the cutter holder are equally spaced.

9. The electric pencil sharpener according to claim 5, wherein the lower end surface of the cutter holder is provided with a contact rod, the contact rod passes through the bottom plate of the hob seat and is exposed outside the hob seat; the bottom of the housing is provided with a switch for opening the driving device; the lower end of the contact rod is provided with a contact head which is positioned above the switch; the spring is provided between the contact head and the switch; when the contact head is moved downwardly to a set position, the contact head presses down the switch to actuate the driving device to operate.

10. The electric pencil sharpener according to claim 1, wherein the hob cutter comprises a cylindrical cutter body and a cutter gear, the cutter gear is fixedly connected to the upper end of the cutter body; the hob cutter is circumferentially rotatable in the cutter holder, and the outer side of the cutter gear is exposed outside the hob seat; an inner gear is provided at a position on the inner wall of the fixed sleeve and corresponding to the cutter gear, the cutter gear is capable of being meshed with the inner gear.

11. The electric pencil sharpener according to claim 10, wherein a plurality of milling cutters are provided on a cylindrical surface of the cutter body, each of the plurality of milling cutters is provided with a helical edge, the outer surface of each the helical edge is provided with a plurality of chip breaker grooves of which the upper and the lower sides arc open.

12. The electric pencil sharpener according to claim 11, wherein helical lines are formed by splicing connected lines of the two adjacent chip breaker grooves of the two adjacent milling cutters; the helical direction of each helical line is opposite to the helical direction of the helical edge.

* * * * *